United States Patent [19]

Hehn et al.

[11] Patent Number: 4,834,238

[45] Date of Patent: May 30, 1989

[54] CASSETTE SECURITY PACKAGE

[75] Inventors: Bruce A. Hehn; James T. Weisburn, both of Massillon, Ohio

[73] Assignee: Alpha Enterprises, Inc., East Canton, Ohio

[21] Appl. No.: 117,310

[22] Filed: Nov. 6, 1987

[51] Int. Cl.[4] ..... B65D 85/67

[52] U.S. Cl. ..... 206/387; 206/1.5; 206/807; 206/45.14; 70/63

[58] Field of Search ..... 206/1.5, 45.14, 387, 206/807; 292/303, 319; 70/58, 63, 69, 401, 408

[56] References Cited

U.S. PATENT DOCUMENTS

| | | | |
|---|---|---|---|
| 320,834 | 6/1885 | Argerbright | 292/303 |
| 1,141,439 | 6/1915 | Woodward | 70/401 |
| 1,157,407 | 10/1915 | Lien | 70/401 |
| 3,125,873 | 3/1964 | Robinson | 70/63 |
| 3,650,382 | 3/1972 | Braun et al. | 206/45.14 |
| 3,871,516 | 3/1975 | Holkestad et al. | 206/54.31 |
| 4,243,142 | 1/1981 | Foreman | 206/387 |
| 4,245,741 | 1/1981 | Holkestad | 206/387 |
| 4,285,429 | 8/1981 | MacTavish | 206/1.5 |
| 4,366,915 | 1/1983 | Seidler | 206/1.5 |
| 4,381,836 | 5/1983 | Rivkin | 206/387 |
| 4,567,983 | 2/1986 | Morris | 206/387 |
| 4,589,549 | 5/1986 | Hehn | 206/387 |
| 4,628,713 | 12/1986 | Ceechi et al. | 70/58 |
| 4,634,004 | 1/1987 | Mortensen | 206/387 |
| 4,658,955 | 4/1987 | Eichner | 206/1.5 |
| 4,662,664 | 5/1987 | Wendt et al. | 70/63 |

*Primary Examiner*—David T. Fidei

*Attorney, Agent, or Firm*—Michael Sand Co.

[57] ABSTRACT

A reuseable one-piece molded plastic package for securely holding and displaying cassettes. A housing forms a storage compartment having an access opening for receiving a cassette. A slide plate is hingedly mounted on the housing and is slideably moved toward the storage compartment to secure a cassette therein. A plurality of slide projections and locking projections are formed on the slide plate and engage slide channels and locking tabs, respectively, formed on the housing to secure the slide plate in locked position. A manually operated key releases the locking tabs from engagement with the locking projections enabling the slide plate to be moved to the unlocked position. In one embodiment the slide plate moves into the access opening to prevent removal of a cassette therefrom, wherein a second embodiment the slide plate engages a hinged cover which forms part of the storage compartment to secure the cover in the closed position.

25 Claims, 5 Drawing Sheets

FIG. 30
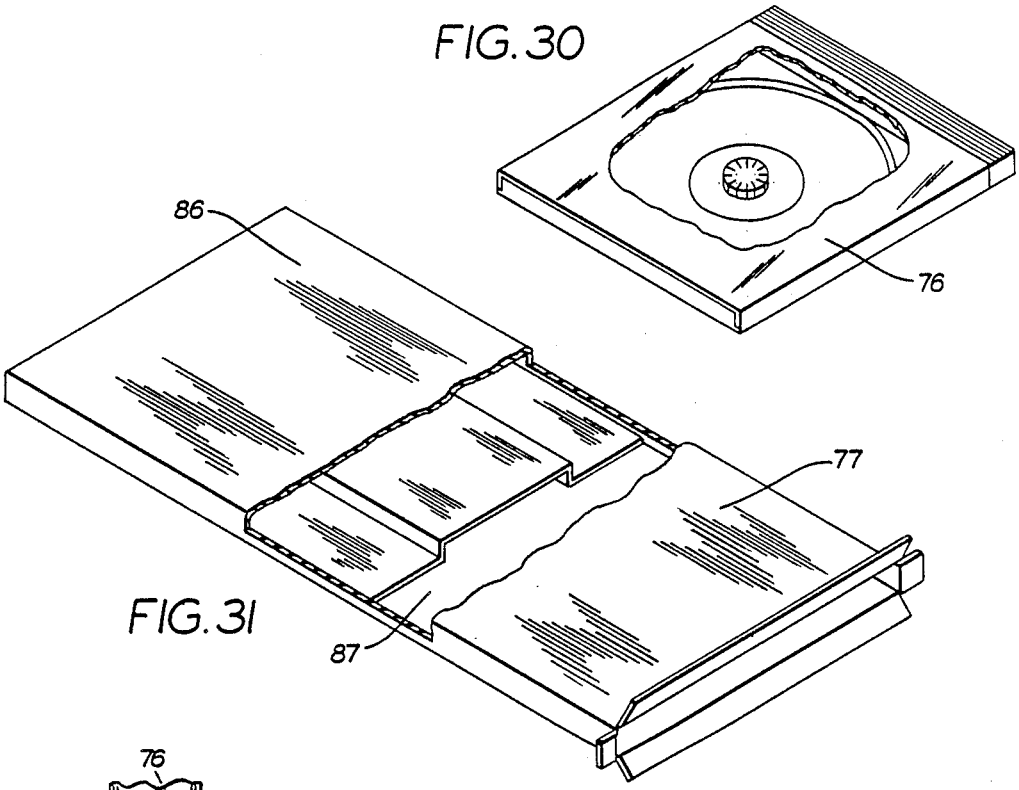
FIG. 31
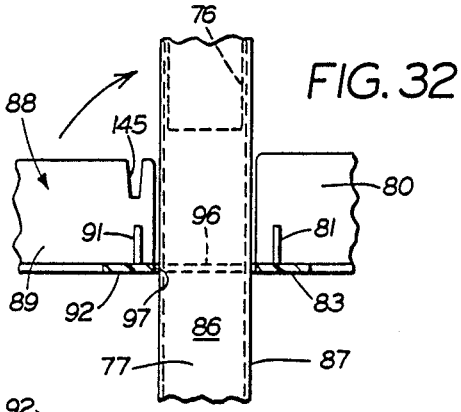
FIG. 32
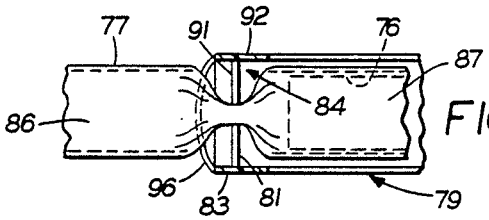
FIG. 33
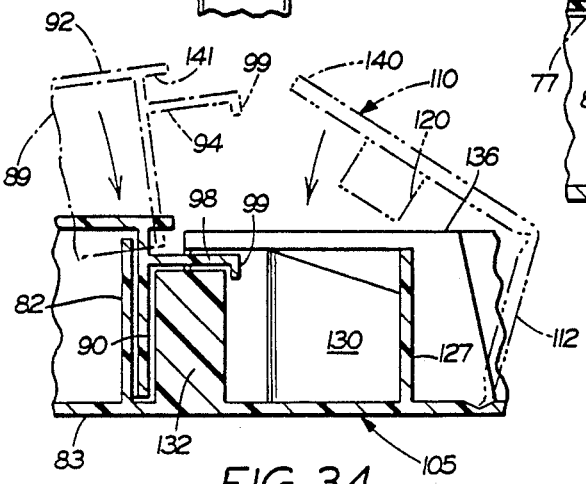
FIG. 34
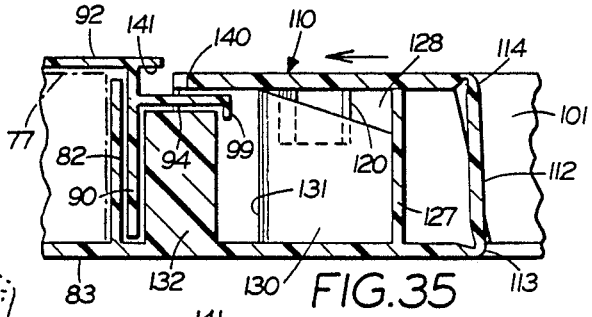
FIG. 35
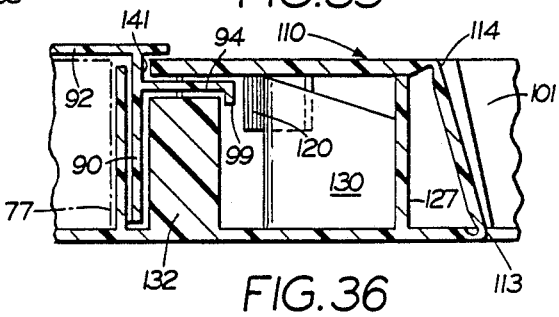
FIG. 36

CASSETTE SECURITY PACKAGE

TECHNICAL FIELD

The invention relates to packages and particularly to a package for holding a cassette. More particularly, the invention relates to a reusable cassette security package having a slide lock which prevents unauthorized removal of the cassette from the package and in which the improved package may be displayed in a usual 8-track cassette case or in a usual L.P. record disc display rack. Furthermore, a compact audio disc may be stored in the improved package.

BACKGROUND ART

In recent years, audio cassettes have become increasingly popular and are approaching outselling usual L.P. record disc sales and are considerably more popular than 8-track audio tapes. The introduction of these cassettes into the audio market presented a problem to the retail sellers in that the cassettes, which are much smaller than the 8-track tapes and record discs, had to be displayed so that prospective purchasers could inspect the same to determine the artist, songs, etc. on the cassettes. This presents a security problem due to the extremely small size of the cassettes in contrast to the record discs and 8-track tapes.

Existing record discs are placed on their edges and displayed in racks since theft of the discs is extremely difficult due to their large size, generally 12 inches by 12 inches. One popular means of storing and displaying 8-track tapes is to place the same in a storage cabinet having a plastic or glass front that is provided with a circular opening through which a prospective purchaser can insert his or her hand and remove an 8-track tape from a horizontal storage shelf and inspect the same through the glass as to the recording artist and particular songs on the tape. The size of the opening in the transparent panel is too small to permit the 8-track tape from being removed through the opening, and it requires an attendant to unlock and open the storage cabinet for final sales.

The small size of the audio cassette makes such methods of display difficult from a security standpoint, since the circular opening in the display rack has to be sufficiently large to enable a prospective buyer to place a hand through the opening for manipulation of the cassette. This opening would be large enough for the cassette to be removed through the opening. Also, open rack display of cassettes in a similar manner as record discs would be extremely vulnerable to theft problems. Therefore, various packaging arrangements have been devised which enable the audio cassettes to be displayed for sale vertically in usual record disc display racks and horizontally in usual 8-track tape cases or suspended from a display rack on hooks or pegs.

Various types of security packages have been developed to provide a safe and secure device for displaying the cassette while retarding removal of the cassette from the package and subsequent theft from the store. Examples of such packages are shown in U.S. Pat. Nos. 3,828,922; 3,871,516; 4,243,142; 4,245,741; 4,285,429; 4,361,233; 4,381,836; 4,466,540; 4,489,832; 4,634,004; 4,567,983; 4,572,369, and 4,635,797. Another prior art package is a rectangular-shaped cardboard box having an opening formed in an upper portion of the box which enables the printed material on the cassette to be read by a prospective purchaser. This entire box and cassette is wrapped in a clear plastic heat shrink paper. This enables the cassettes to be stored in a record disc cabinet and permits a prospective purchaser to read the contents of the tape through the clear window formed by the box opening.

Although these known packages do perform their intended functions, they have several disadvantages. The cardboard packages must be wrapped in a heat shrink paper after the cassette has been placed in the box which requires the record distributor or retailer to purchase a heat-shrink wrapping machine and manually wrap and package each casette. The reuseable, plastic molded type of packages having the key-acutated removable bar are relatively expensive due to the intricate molding operations required to form the dovetail engagement of the locking bar with the remaining housing. Also, the type of package having the pivotally mounted closure portion for entrapping a cassette can only be used once due to the necessity to cut the retaining member to remove the cassette from the unit. Likewise, such packages have several component parts which increase the molding cost of the package.

The closest known prior art to the present invention is shown in U.S. Pat. No. 4,589,549. This package performs its intended functions extremely well, and the present invention is a modification thereof. The primary differences between this prior package and the present invention are as follows. First, the housing and the slide lock of the present package are formed as an integral one-piece member while in the prior art package the housing and slide lock are formed as two separate members. The integral one-piece construction is more cost effective than the separate molding of the two parts and subsequent joining of this prior art package. Secondly, since such packaging devices are mass produced and publicly displayed to market the products contained therein, a thief quickly devises ways to defeat the security aspect of the device. Therefore, the present invention utilizes a different key and locking system than the prior art package to further retard theft of the cassette from the retail store.

Another recent development in the recording industry is the compact disc digital audio system. In this system, the sound is reproduced on a small, convenient sound carrier unit. The disc is approximately ½ inches in diameter and produces a unique combination of digital playback with laser optics. These compact discs, as they are referred to in the audio industry, are finding acceptance in the United States and many foreign countries. Therefore, the need is arising for a security package for storing and displaying these discs.

These discs, due to their relatively small size, have the same theft and display problems discussed above with respect to the usual audio cassette. These compact discs are currently packaged in a plastic box and have a circular recessed holder in one-half of the box with a top half closure that is pivotally mounted on the bottom half. Although these existing packages are satisfactory, they are relatively expensive and do not eliminate the storage and theft problems.

Therefore, the need exists for an improved cassette package which can be used either in the usual 8-track tape storage racks or in the record disc storage racks, and which can be produced inexpensively yet is sufficiently strong and durable so as to be reusable. Furthermore, the need exists for a cassette package which is inexpensive to manufacture, yet which is sophisticated enough to thwart the retail store cassette thief. It is also desirable that such a cassette package be adaptable for use as a storage package for compact audio discs. There is no known cassette package of which I am aware that provides these features and advantages.

DISCLOSURE OF THE INVENTION

Objectives of the invention include providing an improved cassette package which can be mass produced relatively inexpensively as an integral one-piece plastic member, one part of which forms the main housing and another part being a locking plate hingedly attached to and slideably engageable with the housing for securing a cassette in the housing; and in which the package can be manually loaded with a cassette by the retail shop owners and without heat shrink wrapping of the package after the cassette is placed therein.

Another objective is to provide such a package in which the printed information on the cassette is visible through enlarged openings formed in the front and back walls of the housing which forms the package, and in which a cassette is slid easily into a storage compartment formed in the housing and secured therein by the easily operated manual slide lock to prevent unauthorized removal of the cassette from the package.

A further objective is to provide such an improved package in which an inexpensive key formed of molded plastic is insertable into openings formed in the slide plate enabling the plate to be moved to an unlocked position for removal of the cassette from its storage compartment upon completion of a sale enabling the package to be reused for storing another cassette; and in which the key and slide lock are sufficiently different from and more complex than those found in some prior cassette packages to prevent or deter attempts by thieves to open the lock with car keys or other similar devices.

A still further objective is to provide such a package which can be molded of rugged plastic material and reused, thereby reducing the cost to the manufacturer and distributor of the cassettes. Another objective of the invention is to provide such a package in which the housing has an exterior size and configuration which enables the cassette to be stored either horizontally in a display case heretofore used for 8-track units enabling the contents of the cassette to be viewed through an end opening in the housing, or which can be displayed in a usual LP record display case enabling purchasers to leaf through a plurality of cassette packages and inspect the contents of the individual cassettes in their packages through openings formed in the front or back walls of the housing, and in which the package can be suspended on hooks or pegs of a usual display rack.

Still another objective is to provide such a package in which the size of the housing can be increased whereby a compact audio disc or video cassette may be stored in a modified cassette storage compartment and locked in its stored position by the slide plate which is used for locking a cover of the modified cassette storage compartment in a closed position.

A further objective is to provide such a cassette package which is of an extremely simple construction, which achieves the stated objectives in a simple, effective and inexpensive manner, and which solves problems and satisfies needs in the art.

These and other objectives and advantages of the invention are obtained by the improved cassette security package construction for holding a cassette, the general nature of which may be stated as including a housing having a cassette storage compartment formed therein, said compartment having an access opening for inserting and removing a cassette into and out of the compartment, said housing further having at least one slide channel formed therein and locking tab means formed thereon; lock means for releasably securing a cassette in the storage compartment, said lock means comprising a slide plate integrally hingedly mounted on and slideably engageable with the housing and movable between locked and unlocked positions, said slide plate having at least one undercut slide projection formed thereon engageable within the slide channel of the housing to prevent outward movement of said slide plate away from the housing, said slide plate further having at least one locking projection formed thereon slideably engageable with the housing locking tab means for retaining the slide plate in the locked position by preventing sliding movement of the slide plate to the unlocked position; and separate key means engageable with the housing locking tab means for moving said tab means out of engagement with the slide plate locking projection to enable the slide plate to be slid from the locked position to the unlocked position for removing a cassette from the storage compartment.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

FIG. 30 is a perspective view of a usual compact disc for insertion into the storage compartment of the cassette package of FIG. 26;

FIG. 31 is a perspective view with portions broken away, of a usual cardboard reinforcing sleeve which holds a compact disc for display in retail stores;

FIG. 32 is a fragmentary sectional view of the display sleeve containing a compact disc inserted in the opening formed between the storage compartment and the cover when in open position;

FIG. 33 is a fragmentary sectional view similar to FIG. 32 showing the cover in the closed position;

FIG. 34 is a greatly enlarged fragmentary sectional view similar to FIG. 18 showing in dot-dash lines the direciton of movement of the cover toward the closed position and the slide plate toward engagement with the lock housing;

FIG. 35 is a greatly enlarged fragmentary sectional view showing the cover in the closed position and the slide plate engaged with the lock housing prior to being moved toward the locked position; and FIG. 36 is a greatly enlarged fragmentary sectional view similar to FIG. 35, showing the slide plate in the locked position.

Similar numerals refer to similar parts throughout the drawings.

BEST MODE FOR CARRYING OUT THE INVENTION

Figure 1:
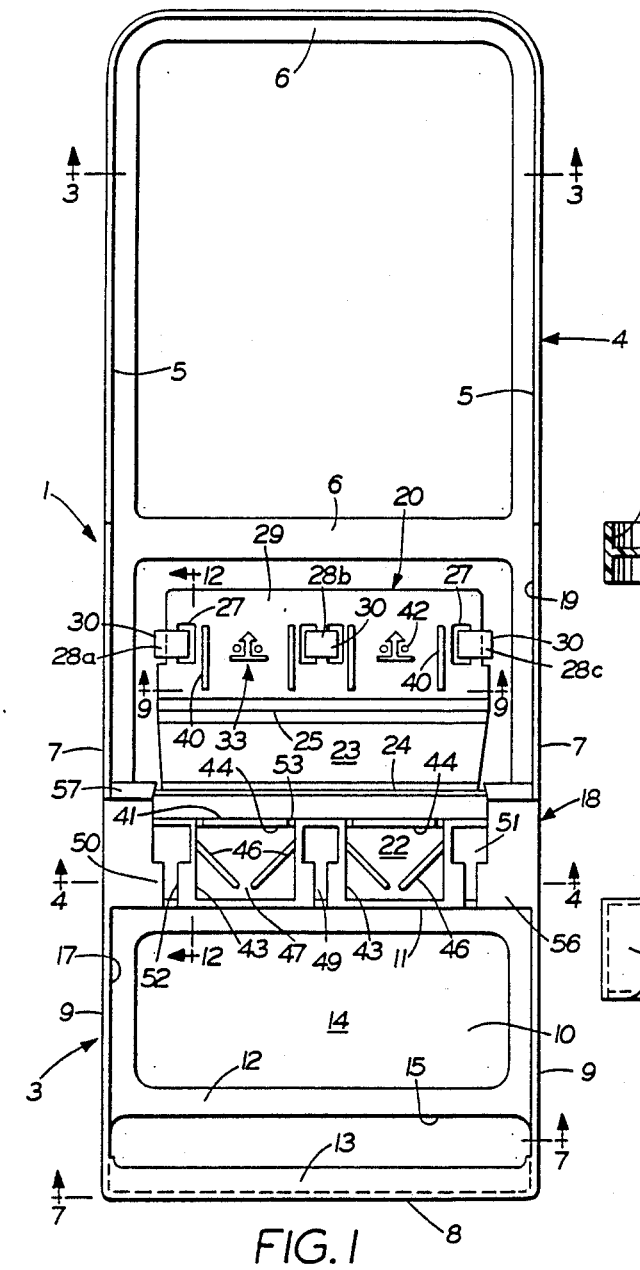
FIG. 1 is a top plan view of a first embodiment of the cassette security package in an unlocked position.
Figure 2:
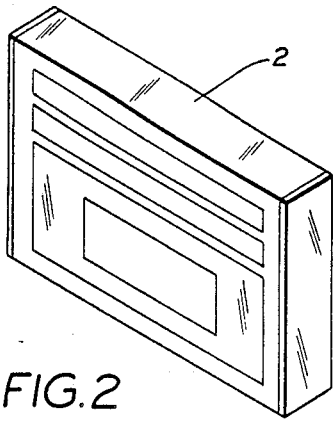
FIG. 2 is a perspective view of a usual audio cassette for insertion into the storage compartment of the cassette package of FIG. 1.
Figure 3:
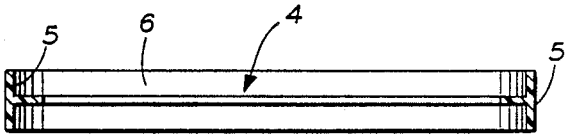
FIG. 3 is an enlarged sectional view taken on line 3—3, FIG. 1.

A first embodiment of the improved cassette security package of the invention is indicated generally at 1, and is shown in FIG. 1. Cassette package 1 in its intended use stores a usual audio cassette 2 of the type shown in FIG. 2, for retail store display of the cassette and to prevent unauthorized removal of the cassette from the store, Cassette package 1 is formed as a one-piece molded plastic unit preferably molded of high impact polypropylene or other suitable moldable plastic. Package 1 includes a housing, indicated generally at 3, formed at one end thereof having a generally rectangular shape (FIG. 1) and having a hanger, indicated generally at 4, formed on the opposite end thereof. Hanger 4 includes a pair of T-shaped side walls 5 and similarly shaped end walls 6 (FIG. 3). Hanger 4 enables the package to be mounted on display hooks or pegs and provides sufficient size to the package making it difficult for a thief to easily conceal the package for unauthorized removal from a retail store. Housing 3 is integrally connected to hanger 4 by tapered side wall sections 7.

Figure 7:
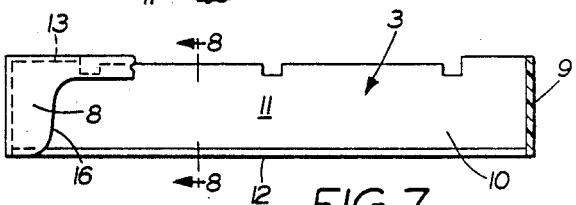
FIG. 7 is an enlarged sectional view with portions broken away, taken on line 7—7, FIG. 1.
Figure 8:
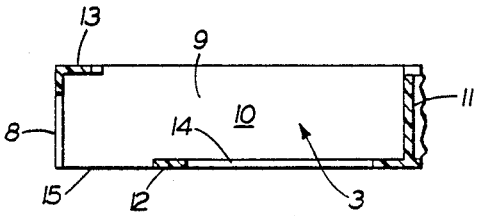
FIG. 8 is a fragmentary sectional view taken on line 8—8, FIG. 7.
Figure 4:
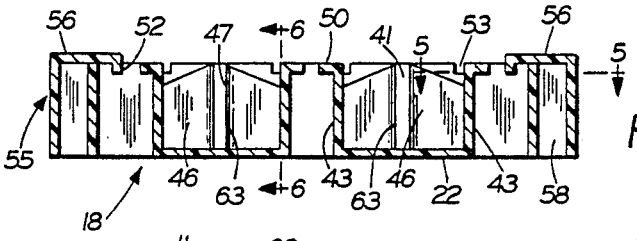
FIG. 4 is an enlarged sectional view taken on line 4—4, FIG. 1.
Figure 6:
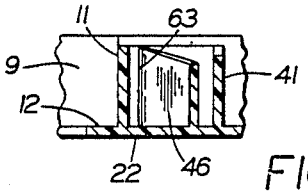
FIG. 6 is an enlarged fragmentary sectional view taken on line 6—6, FIG. 4.

Housing 3 includes a front wall 8, a pair of side walls 9 which are integral continuations of tapered walls 7, a transversely extending rear wall 11, and a partial bottom wall 12 (FIGS. 1 and 8), which walls form a cassette storage compartment 10. A top flange 13 projects inwardly from the top of end wall 8 and serves as a retaining lip for the front upper edge of an audio cassette inserted in storage compartment 10. The cassette storage compartment has dimensions which are complementary to the size of a usual audio cassette. A generally rectangular cutout 14 is formed in partial bottom wall 12 and another opening 15, bounded by portions of side walls 9, front wall 8 and bottomn wall 12, enables the contents of a cassette, such as the artist, songs, etc., inserted in compartment 10, to be viewed from the bottom of the compartment by a prospective purchaser without removing the cassette from package 1 (FIG. 1). Front end wall 8 also is formed with an opening 16 (FIG. 7) enabling the printing on the frontward facing edge of a cassette to be viewed therethrough. Furthermore, a generally rectangular opening 17 formed in the top of housing 3 and defined by side walls 9, rear wall 11, and flange 13 forms the access opening for inserting and removing a cassette into and from storage compartment 10.

A generally rectangular opening 19 is a located between hanger end wall 6, tapered wall sections 9 and a lock housing, indicated generally at 18 (FIG. 1). Opening 19 provides the space for the formation of a slide plate, indicated generally at 20, during the mold forming of package 1.

Figure 11:
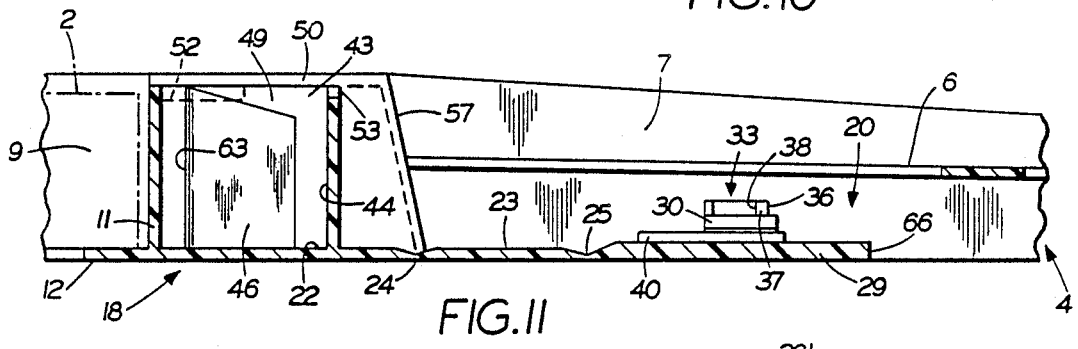
FIG. 11 is a fragmentary sectional view taken on line 11—11, FIG. 10, showing the locking slide plate in unlocked position.
Figure 12:
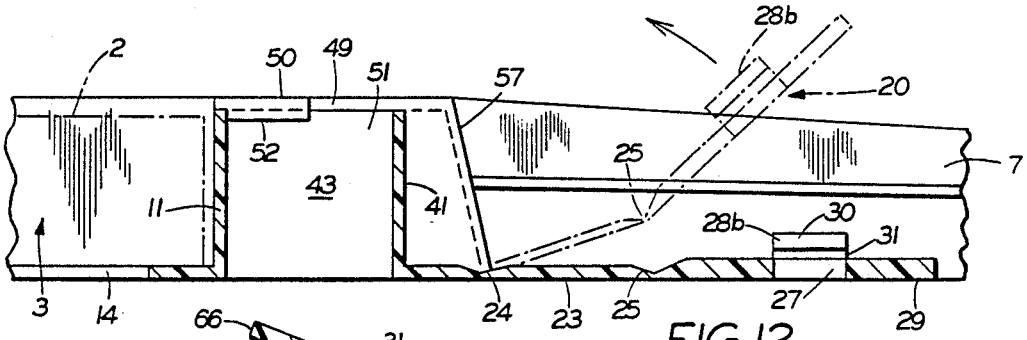
FIG. 12 is a greatly enlarged, fragmentary sectional view taken on line 12—12, FIG. 1, showing the slide plate in unlocked position and moving toward engagement with the housing in dot-dash lines.
Figure 23:
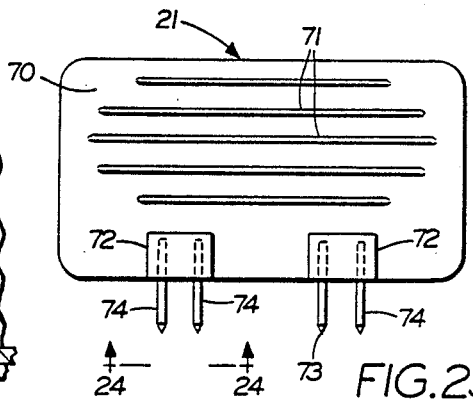
FIG. 23 is a side elevational view of the key.

In accordance with one of the features of the invention, slide plate 20 (FIG. 1) is hingedly mounted on and slidably engaged with lock housing 18 for locking a cassette in storage compartment 10 until the cassette is removed by a sales clerk by use of a manually operated key, indicated generally at 21 and shown in FIG. 23. Slide plate 20 is integrally hingedly attached to a bottom wall 22 of lock housing 18 by a double hinged plate 23. Plate 23 has a first hinge 24 integral with wall 22 and a second hinge 25 which connects plate 23 to slide plate 20. Slide plate 20 and hinge plate 23 form a generally smooth continuous bottom surface with hinges 24 and 25 being formed by V-shaped cutouts formed in the slide plate and hinge plate. (FIGS. 11 and 12).

Figure 9:
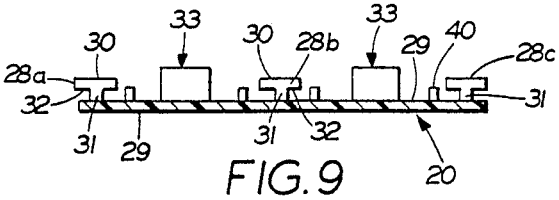
FIG. 9 is an enlarged sectional view taken on line 9—9, FIG. 1.

A plurality of rectangular openings 27 are formed in slide plate 20 for injection molding three undercut, T-shaped slide projections 28*a*, 28*b*, and 28*c* on bottom surface 29 of the slide plate (FIGS. 1, 9, 10, 11 and 12). Each slide projection 28 has a rectangular-shaped base 30 and a connecting bar 31. Projections 28 are integrally molded in a spaced relationship on bottom surface 29 of slide plate 20. Two of the undercut slide projections 28*a* and 28*c* are mounted on the outer edges of the slide plate and the third slide projection 28*b* is a centered therebetween. The width of bar 31 is smaller than the width of base 30 thereby forming an undercut 32 therebetween (FIG. 9).

A pair of locking.projections, indicated generally at 33, are molded on bottom surface 29 of slide plate 20 (FIGS. 1 and 10) and are located between T-shaped slide projectons 28. A pair of openings 42 are formed adjacent each locking projection and function as key openings through which key 21 (FIG. 23) is inserted when it is desired to move slide plate 20 from a locked to an unlocked position as will be described in greater detail below. Each locking projection 33 has a generally T-shaped configuration, defined by a reinforcing base 34 and an outwardly projecting post 35 which terminates in an arrow-shaped wedge 36 (FIGS. 1, 10, 11 and 17). Each wedge 36 has a pair of angled camming surfaces 37 which form undercuts 38 with post 35 of locking projection 33. A plurality of reinforcing ribs 40 preferably are formed on bottom surface 29 of slide plate 20 to increase the strength thereof and reduce flexing of the plate.

Lock housing 18 includes a rear wall 41 which is spaced from and parallel to rear wall 11 of housing 3 and extends upwardly from bottom wall 22 as does rear wall 11 (FIG. 1). Four partition walls 43 extend between walls 11 and 41 forming a pair of compartments 44 therebetween. A pair of locking tabs 46 extend upwardly from bottom wall 22 within each compartment 44 for engagement with a respective one of the locking projections 33 (FIGS. 1, 4, 10, and 16). Each pair of locking tabs 46 forms a generally V-shaped configuration with the apex or front ends of each pair of tabs being positioned adjacent each other forming a slot 47 therebetween.

Figure 10:
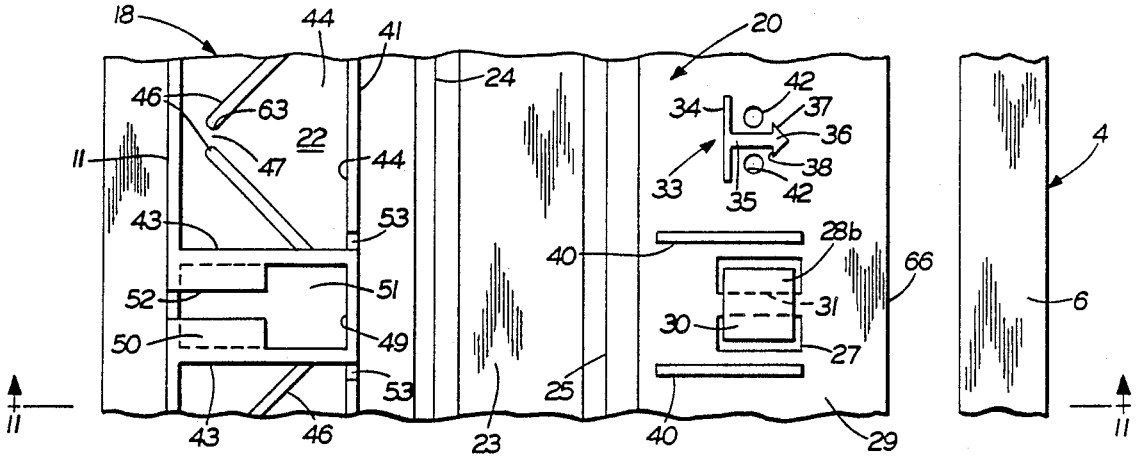
FIG. 10 is a greatly enlarged, fragmentary top plan view, showing the center slide channel and portions of the locking tabs, center slide projection, adjacent locking projection, and key openings in the slide plate.

Lock housing 18 further includes three T-shaped slide channels 49 formed in the center and on the ends thereof (FIGS. 1 and 10). Channels 49 are formed in top wall portions 50 of lock housing 18 which extend between walls 11 and 41 and are located to engage a respective one of the slide projections 28. Each slide channel 49 has a rear portion 51 with dimensions slightly smaller than that of base 30 of undercut slide projections 28 whereby each of the slide projections 28 is snapped into engagement within a respective one of the slide channels 49, as shown particularly in FIGS. 12–14. A front portion 52 of each slide channel 49 has a width slightly wider than the width of bar 31 of each slide projection 28 whereby each bar 31 can be slidingly moved along front portion 52 of channel 49 to a position adjacent wall 11, at which position slide plate 20 is in a locked position.

A plurality of notches 53 (FIGS. 1 and 4) are formed in the top edge of lock housing wall 41 and are located to align with a respective one of the ribs 40 and are complementary in size thereto, to provide guidance and stability to top slide plate 20 when the slide projections thereof are snapped into slide channels 49 and moved forwardly into the locked position.

Figure 5:
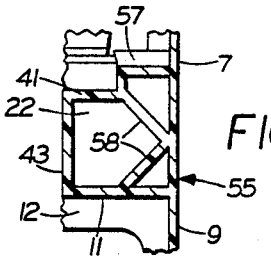
FIG. 5 is an enlarged fragmentary sectional view taken on line 5—5, FIG. 4.

A side support structure, indicated generally at 55 (FIGS. 1 and 4) is located at the outer side of lock housing 18 adjacent each of the two outermost slide channels 49. Each support structure 55 includes a generally rectangular top wall 56 which is integrally connected to and extends between the top of side wall 7, end wall 11 and wall 41. A sloped wall 57 is formed integrally with and extends downwardly from top wall 56. A pair of V-forming walls 58 extend between lock housing forming walls 7, 11, and 41 beneath top wall 56 (FIG. 5) to reinforce support structure 55 and lock housing 18.

Figure 13:
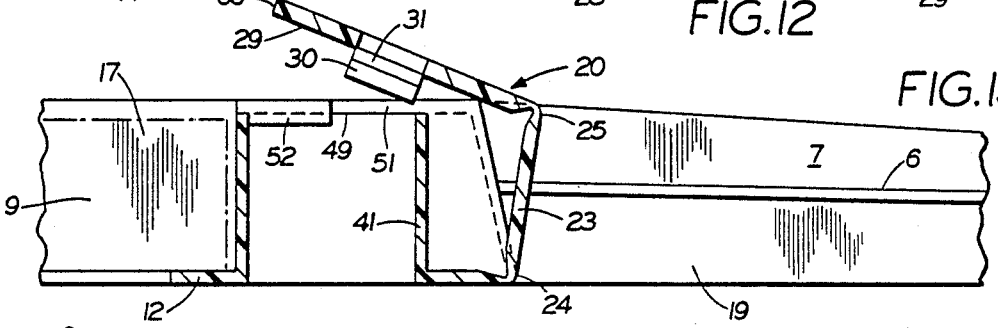
FIG. 13 is a view similar to FIG. 12, showing the slide projection starting to enter the slide channel.
Figure 14:
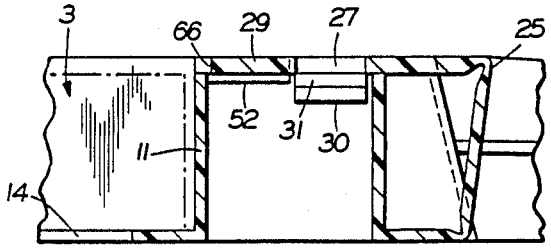
FIG. 14 is a view similar to FIGS. 12 and 13, showing the slide projection fully engaged within the slide channel, and the slide plate still in an unlocked position.
Figure 18:
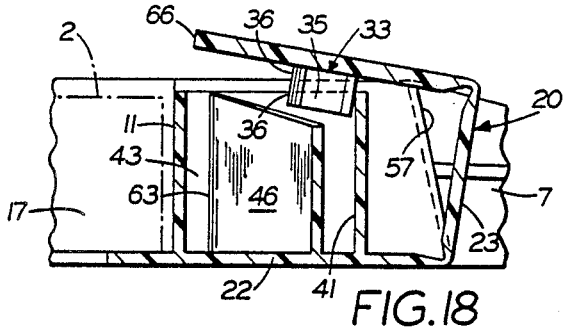
FIG. 18 is a greatly enlarged sectional view showing the position of one of the locking projections relative to a pair of the locking tabs as the slide plate is being moved toward engagement with the housing.

The operation, features and advantages of improved cassette security package 1 and in particular the operation of improved slide plate 20 is best understood by referring to FIGS. 11–15 and 18–22. Slide plate 20 is pivotally moved from its fully opened molded position of FIGS. 1 and 11 to a position as shown in FIGS. 13 and 18 wherein slide plate 20 is just above, yet not engaged with, lock housing 18. Continued downward movement of slide plate 20 will snap bases 30 of slide projections 28 into rear portions 51 of slide channels 49 (FIGS. 13 and 14). In this position locking projections 33 will be in the position of FIG. 19, with wedge ends 36 rearward of slots 47 of locking tabs 46.

Figure 15:
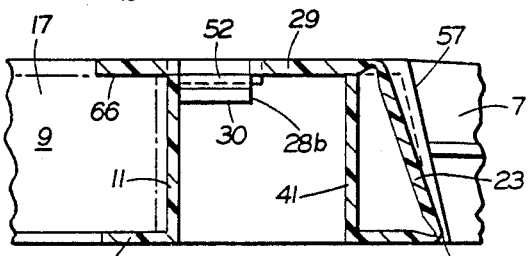
FIG. 15 is a view similar to FIG. 14, showing the slide plate in the locked position and extending over a portion of an audio cassette inserted in the storage compartment.
Figure 16:
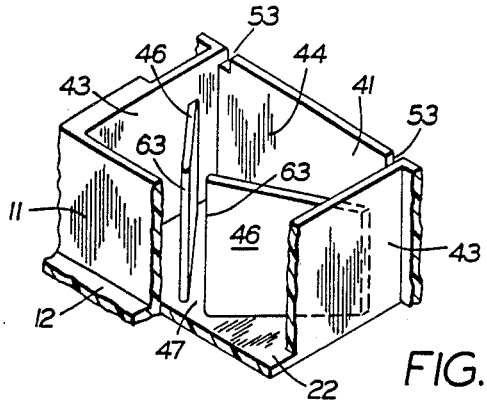
FIG. 16 is a greatly enlarged fragmentary perspective view with portions broken away, of a pair of the locking tabs of the cassette package.
Figure 17:
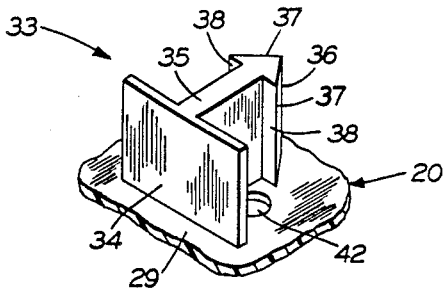
FIG. 17 is a greatly enlarged fragmentary perspective view of one of the locking projections and key openings.
Figure 20:
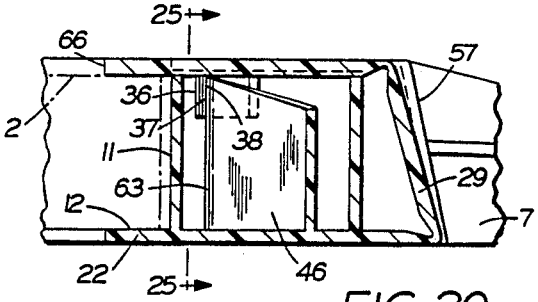
FIG. 20 is a view of the locking projection of FIG. 19, engaged with the locking tabs when in the locked position similar to the position shown in FIG. 15.
Figure 21:
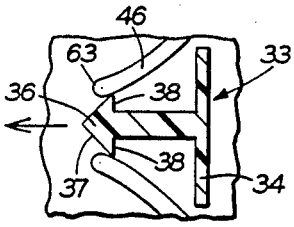
FIG. 21 is a greatly enlarged fragmentary sectional view of one of the locking projections engaging a pair of the locking tabs.

Slide plate 20 then is slide forwardly with connecting bars 31 of slide projections 28 moving along front portions 52 of slide channels 49 until bases 30 engage storage compartment wall 11 and slide plate 20 reaches the locked position of FIGS. 15 and 20. During movement of slide plate 20 into the locked position, camming surfaces 37 of each wedge 36 slide along the inner surfaces of each pair of locking tabs 46 (FIG. 21) flexing tabs 46 outwardly. As wedges 36 pass through slots 47 of locking tabs 46, front ends 63 thereof snap back into their normal position and engage undercuts 38 of locking projections 33 (FIGS. 22) securely locking slide plate 20 in its forward locked position with lock housing 18.

Figure 22:
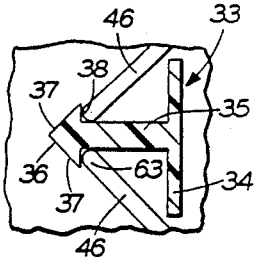
FIG. 22 is a view of the locking projection of FIG. 21, in locked position with the locking tabs as shown in FIG. 20.

When locking projections 33 are in their frontwardmost locked positions as shown in FIGS. 20 and 22, slide plate 20 is prevented from being moved to an unlocked rearward position by the engagement of front ends 63 of locking tabs 46 with undercuts 38. The engagement of wedges 36 with locking tabs 46 retains the front or locking edge 66 of slide plate 20 in locked engagement with the upper rear surface of a cassette 2 previously inserted in storage compartment 10 through access opening 17 (FIGS. 15 and 20). The front edge of the cassette is secured in compartment 10 by retaining flange 13. The engagement of the front edge of each slide projection 28 with the rearward surface of transverse wall 11 (FIG. 15) limits the forward movement of the slide plate and wedges 36 of locking projections 33 to a location just beyond the front edges 63 of locking tabs 46.

Pivotal upward movement of slide plate 20 is prevented by engagement of base 30 of slide projections 28 with top wall portions 50 of lock housing 18. When the slide plate is in this frontward locked position, an audio cassette is securely retained within the storage compartment and unauthorized removal is prevented by front edge 66 of slide plate 20, housing flange 13, side walls 9, front wall 8, rear wall 11, and bottom wall 12 all of which form compartment 10. The slide plate cannot be moved in a rearward direction due to the engagement of locking projections 33 with locking tabs 46 until the tabs are disengaged therefrom by use of key 21.

Figure 24:
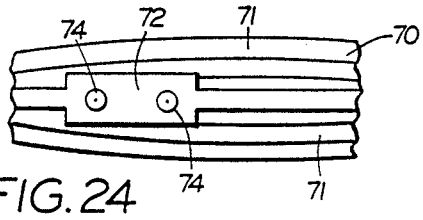
FIG. 24 is a fragmentary bottom view of the key looking in the direction of arrows 24—24, FIG. 23.

Key 21 (FIGS. 23 and 24) includes a relatively flat rectangular-shaped plate 70 provided with a plurality of arcuate-shaped outwardly extending stiffening ribs 71 on both sides thereof. Four unlocking tangs 74, preferably formed of metal, are molded within a pair of reinforcing blocks 72 and project outwardly from one end of plate 70. Plate 70, ribs 71 and reinforcing blocks 72 preferably are integrally molded as a one-piece plastic member formed of a high strength polystyrene or similar plastic material.

Figure 25:
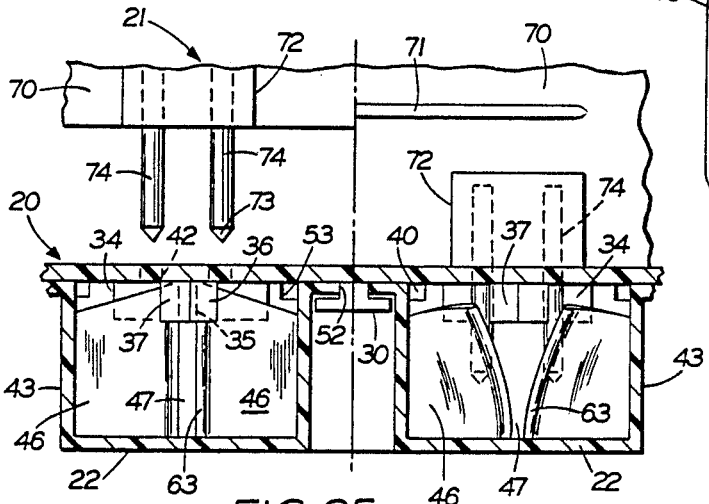
FIG. 25 is a composite fragmentary sectional view taken on line 25—25, FIG. 20, showing the engagement of the key tangs with a pair of the locking tabs for unlocking the slide plate.

To unlock tabs 46 from engagement with locking projections 33, each tang 74 of key 21 is inserted from the top of the lock housing through a respective one of the four openings 42 formed in slide plate 20 (FIGS. 1, 10, and 25). Two openings 42 are formed on opposite sides of each locking projection post 35. A camming surface 73 formed on the outer pointed ends of each tang 74 engages the inward surface of a respective one of the front locking tab ends 63 forcing the front end of each tab 46 outwardly increasing the size of slot 47 to provide sufficient clearance for the rearward movement of wedge 36 through the slot and thus movement of slide plate 20 to the unlocked position. Front edge 66 of slide plate 20 is disengaged from the upper rear edge of an audio cassette previously secured in the storage compartment when in the unlocked position, permitting easy removal of the cassette from its stored position.

Figure 19:
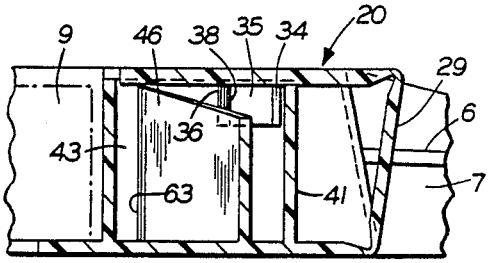
FIG. 19 is a view similar to FIG. 18, showing the position of the locking projection just prior to locking engagement with the locking tabs similar to the position shown in FIG. 14.

Slide plate 20 is retained in engagement with lock housing 18 in the position shown in FIGS. 14 and 19 after being moved to the unlocked position due to the snap-fit engagement of slide projection base 30 of each slide projection 28, within slide channel rear portions 51. In this position a new cassette 2 can be placed in storage compartment 10 and slide plate 20 moved forwardly to the locked position without reinserting bases 30 in slide channel portions 51 as required the initial time the package is used to store a cassette after molding. This provides ease of reusing the package since it is ready for reloading by a sales clerk immediately after the previous cassette is removed from compartment 10.

Thus, cassette package 1 provides a reusable, low-cost, sturdy device for the display of audio cassettes in retail outlets, and allows a prospective purchaser to browse through the cassettes without the assistance of a sales clerk while discouraging and retarding theft of the cassettes. When a purchaser decides to purchase a cassette, he or she takes the cassette package and its contents home. When the purchaser is ready to use the cassette, he or she cuts open the package, preferably across front wall 8 and top flange 13, removes the cassette and disposes of the package. However, when unsold cassettes are returned to the distributor, they are removed from the package by a clerk using the key. Thus, the package remains intact and may be reloaded with a different cassette and returned to the display rack for sale.

Figure 26:
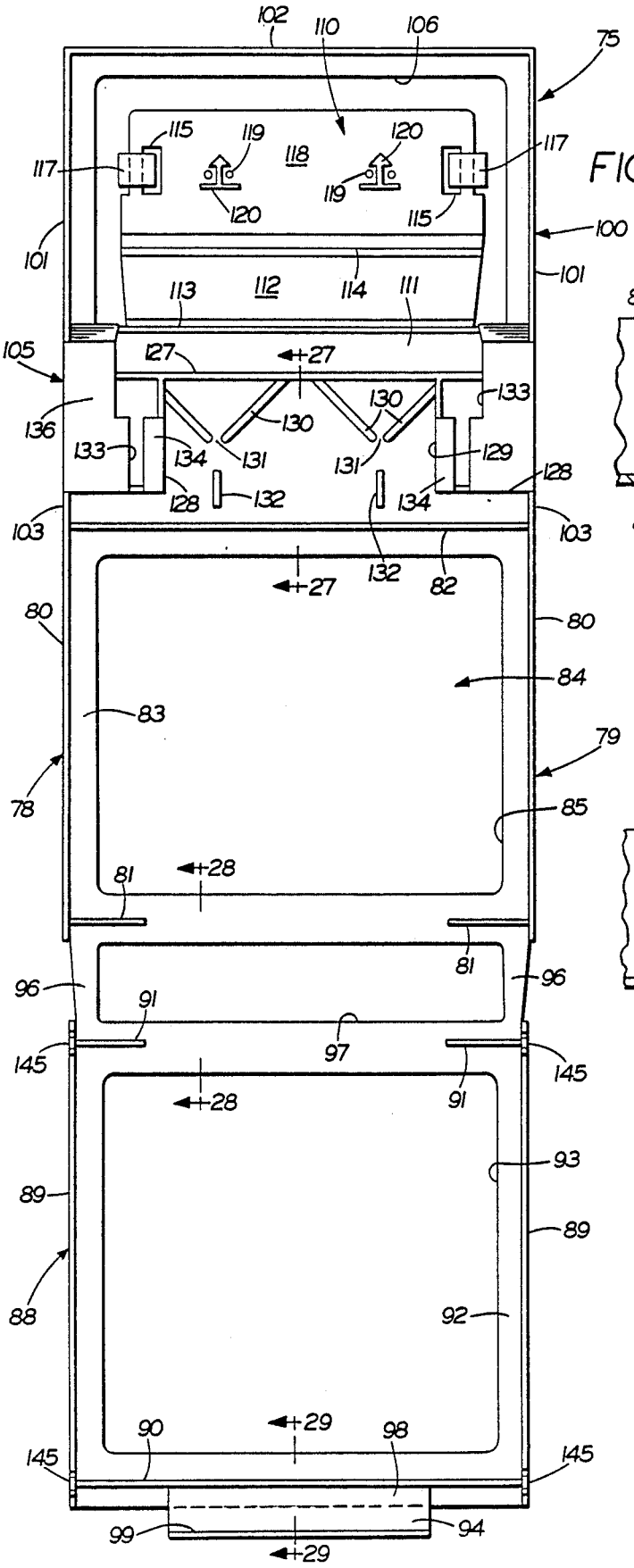
FIG. 26 is a top plan view of a second embodiment of the cassette security package for holding a compact disc in a fully open unlocked position.

A second embodiment of the improved cassette security package of the invention is indicated generally at 75, and is shown in FIG. 26. Cassette package 75 stores a usual digital audio compact disc 76 of the type shown in FIG. 30, for retail store display and to reduce the unauthorized removal of the disc from the package and store. Manufacturers typically package the compact discs in cardboard display sleeves 77 of the type shown in FIG. 31, which have a cardboard reinforced end 86 and a hollow disc-containing end 87. Therefore, it is important that the improved security package and operation thereof is unaffected by the presence or absence of outer sleeve 77.

Cassette security package 75 is formed as a one-piece molded plastic unit, preferably molded of high impact polypropylene, as is package 1, and includes a rectangular shaped housing, indicated generally at 79, formed at one end thereof (FIG. 26). Housing 79 includes a base 78 and a cover 88 which together form a casette storage compartment 84 when cover 88 is in a closed position.

Base 78 includes a pair of side walls 80, a transversely extending rear wall 82, a pair of aligned inwardly extending pinch ribs 81 opposite and spaced frontwardly from wall 82, and a partial bottom wall 83 (FIG. 26). Base 78 has dimensions which are complementary to the size of a usual digital audio compact disc. A generally rectangular-shaped cutout 85 is formed in partial bottom wall 83 enabling the contents of a compact disc, such as the artist, songs, etc., inserted in cassette storage compartment 84, to be viewed from the bottom of the compartment by a prospective purchaser without removing the compact disc from package 75 (FIG. 26).

Figure 29:
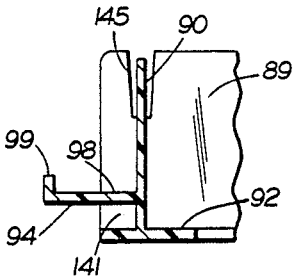
FIG. 29 is a greatly enlarged fragmentary sectional view taken on line 29—29, FIG. 26.

Cassette storage compartment cover 88 (FIG. 26), is formed by a pair of side walls 89, a transversely extending front wall 90, and a partial top wall 92 formed with a pair of pinch ribs 91. Cover 88 has dimensions which are complementary to the size of a usual compact disc 76 and which allow sidewalls 89 to locate inwardly of sidewalls 80 of base 78 when cover 88 is moved to the closed position. A generally rectangular cutout 93 is formed in top wall 92 enabling the contents of a compact disc inserted in storage compartment 84 to be viewed from the top of the compartment by a prospective purchaser without removing the compact disc from package 75 when the cover is in the closed position. An L-shaped locking flange 94 having an outwardly extending portion 98 and a lip portion 99, extends frontwardly from and is integral with wall 90 (FIG. 29) of cover 88.

Cover 88 is integrally attached to base 78 by a pair of spaced strap hinges 96 which extend between bottom wall 83 of the base and top wall 92 of the cover forming a generally rectangular-shaped opening 97 therebetween (FIG. 26). A display sleeve 77 containing a compact disc is insertable through opening 97 prior to closing cover 88 and locking the compact disc in storage compartment 84, as will be described in greater detail below.

A hanger, indicated generally at 100, is formed on the end of package 75 opposite from the housing end and includes a pair of L-shaped side walls 101 and a similarly shpaed end wall 102 (FIG. 26). Hanger 100 is integrally connected to housing 78 by a pair of sidewalls 103 of a lock housing, indicated generally at 105. Hanger 100 enables the package to be mounted on display hooks or pegs and provides additional size to the package making it difficult for a thief to easily conceal the package for unauthorized removal from a retail store.

A generally rectangular opening 106 (FIG. 26) similar to opening 19 of package 1, is located between hanger end wall 102, side walls 101 and lock housing 105. Opening 106 provides the space for the formation of a slide plate, indicated generally at 110, during the mold forming of package 75.

In accordance with a main feature of cassette package 75 of the invention, slide plate 110 (FIG. 26), which is similar to slide plate 20 of package 1, is hingedly mounted on and slideably engaged with lock housing 105 for locking cassette cover 88 in closed position to retain a compact disc 76 in storage compartment 84 until the compact disc is removed by a sales clerk by use of the same manually operated key 21 (FIG. 23) used to remove an audio cassette from package 1. Slide plate 110 (FIG. 26) is integrally hingedly attached to a bottom wall 111 of lock housing 105 by a double-hinged plate 112 having a first hinge 113 and a second hinge 114, which plate 112 is similar to plate 23 of package 1.

A pair of rectangular openings 115 are formed in slide plate 110 for injection molding a pair of undercut, T-shaped slide projections 117 on bottom surface 118 of the slide plate (FIG. 26). Slide projections 117 are similar to slide projections 28 of package 1 and are mounted on the outer edges of the slide plate.

A pair of locking projections 120, similar to locking projections 33 of package 1, are molded on bottom surface 118 of slide plate 110 (FIG. 26) and are located between slide projections 117. A plurality of key openings 119, similar to openings 42 of package 1, cooperate with key 21 (FIG. 23) to move slide plate 110 from a locked to an unlocked position in a similar manner as discussed above with respect to slide plate 20.

Figure 27:
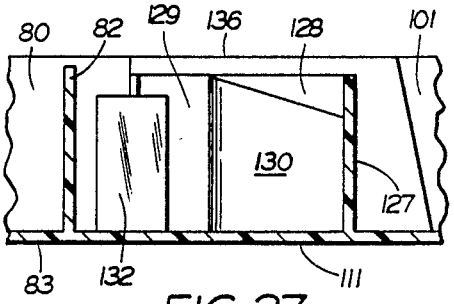
FIG. 27 is a greatly enlarged fragmentary sectional view taken on line 27—27, FIG. 26.
Figure 28:
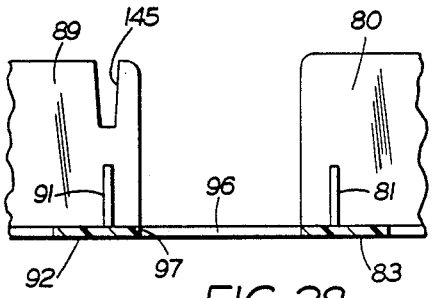
FIG. 28 is a greatly enlarged fragmentary sectional view taken on line 28—28, FIG. 26.

Lock housing 105 includes a wall 127 formed on bottom wall 111 which is spaced from and parallel to rear wall 82 of base 78 (FIGS. 26 and 27). A pair of L-shaped walls 128 extend between walls 127 and 103. A lock housing compartment 129 is defined by walls 82, 103, 111, 127 and 128. Two pairs of locking tabs 130, similar to locking tabs 46 of package 1, extend upwardly from bottom wall 111 within compartment 129 for engagement with a respective one of the locking projections 120. Each pair of locking tabs 130 forms a generally V-shaped configuration having a slot 131 therebetween. A pair of rectangular-shaped spacers 132 extend upwardly from bottom wall 111 within compartment 129 for engagement with L-shaped extension 94 and front wall 90 of cover 88 when the cover is in the closed position.

Lock housing 105 further includes a pair of T-shaped slide channels 133, similar to slide channels 49 of package 1 (FIG. 26). Channels 133 are formed in top wall portions 134 which extend frontwardly from the top of wall 127 into compartment 129 and are located to engage a respective one of the slide projections 117. A support structure 136 (FIG. 26), similar to support structure 55 of package 1 is located at the ends of lock housing 105 adjacent each of the two slide channels 133.

The operation, features and advantages of improved cassette security package 75 and in particular the operation of improved slide plate 110 and cover 88 is best understood with respect to FIGS. 32 through 36. Slide plate 110 is pivotally moved from its fully opened molded position of FIG. 26 to a position as shown in dot-dash lines in FIG. 34 wherein slide plate 110 is jsut above, yet not engaged with, lock housing 105. Continued downward movement of slide plate 110 will snap slide projections 117 into slide channels 133 in the manner described for package 1. In this position locking projections 120 will be in the position of FIG. 35 rearward of slot 131 of locking tabs 130.

Prior to closing cover 88, a display sleeve 77 containing a compact disc 76 in its hollow end 87 is inserted through opening 97 with the compact disc-containing end 87 being located above opening 97 and cardboard reinforced end 86 being located below the opening as shown in FIG. 32. Cover 88 then is moved in the direction of the arrow in FIG. 32 and then into the position of FIG. 33 to trap the compact disc-containing end of sleeve 77 in cassette storage compartment 84 of housing 79. As cover 88 is moved to the closed position, front wall 90 locates rearwardly of housing wall 82, with frontward movement of the front wall and in turn the cover being prevented by wall 82 and rearward movement thereof prevented by spacers 132 (FIG. 34). Horizontal portion 98 of extension 94 locates adjacent the top edge of spacers 132, with vertical flange 99 locating rearwardly of and adjacent to the spacers. Two pairs of slots 145 formed in side walls 89 cooperate with pinch ribs 81 and rear wall 82 permitting cover 88 to move to a fully closed position.

Reinforced end 86 of sleeve 77 extends frontwardly through opening 97 when the cover is closed enabling the printing on the reinforced end of the display sleeve to be viewed without obstruction from the package by prospective purchasers of the compact disc. In addition, the outward extension of the reinforced end of display sleeve 77 from housing 79 adds length to the package to discourage or prevent theft of the compact disc contained therein from a retail store.

Compact disc-containing end 87 of sleeve 77 is prevented from being removed from cassette storage compartment 84 through opening 97 by pinch ribs 81 and 91. When cover 88 is moved to the closed position, cover pinch ribs 91 align with base pinch ribs 81 to squeeze sleeve 77 therebetween. If desired compact disc 76 can be inserted into storage compartment 84, without outer display sleeve 77.

After closing cover 88, slide plate 110 is slid forwardly in the direciton of the arrow of FIG. 35, with slide projection 117 moving along slide channels 133 and locking projections 120 engaging locking tabs 130 in the manner described above for package 1, until slide plate 110 reaches the locked position of FIG. 36. When slide plate 110 is in the locked position, front edge 140 of the slide plate slides within a U-shaped slot 141 formed on the outer end of cover 88 to prevent pivotal upward movement of cover 88 away from base 78.

Cover 88 is maintained in the closed position by slide plate 110 which is maintained in the locked position as shown in FIG. 36 by the engagement of locking projections 120 with slide channels 133 until tabs 130 are flexed outwardly by key tangs 74.

Front edge 140 of slide plate 110 is disengaged from the U-shaped slot 141 of cover 88 when in the unlocked position, permitting pivotal movement of the cover to its open position of FIG. 32 and subsequent removal of the compact disc from its stored position.

Slide plate 110 is retained in engagement with lock housing 105 after being moved to the unlocked position due to the snap-fit engagement of slide projections 117 within slide channels 133 as described above for package 1.

Thus, cassette package 75 provides a reuseable, low-cost, sturdy device for the display of compact discs in retail outlets, and allows a prospective purchaser to browse through the compact discs without the assistance of a sales clerk while discouraging and/or preventing the theft of the discs. When a purchaser decides to purchase a disc, he or she presents the package containing the desired disc to a sales clerk who removes the disc from the package using a key as in package 1.

The term cassette as used herein need not be limited to audio cassettes but includes video cassettes, compact discs and similar articles.

Accordingly, the improved cassette security package is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved cassette security package is constructed and used, the characteristics of the construction, and the advantageous, new and useful results obtained; the new and useful structures, devices, elements, arrangements, parts, and combinations, are set forth in the appended claims.

What is claimed is:

1. A package construction for holding a cassette including:

(a) a housing having a cassette storage compartment formed therein, said compartment having an access opening for inserting and removing a cassette into and out of the compartment, said housing further having at least one slide channel formed therein and locking tab means formed thereon:

(b) lock means for releasably securing a cassette in the storage compartment, said lock means comprising a slide plate integrally hingedly mounted on and slideably engageable with the housing and movable between locked and unlocked positions, said slide plate having at least one undercut slide projection formed thereon engageable within the slide channel of the housing to prevent outward movement of said slide plate away from the housing, said slide plate further having at least one locking projection formed thereon slideably engageable with the housing locking tab means for retaining the slide plate in the locked position by preventing sliding movement of the slide plate to the unlocked position; and (c) separate key means engageable with the housing locking tab means for moving said tab means out of engagement with the slide plate locking projection to enable the slide plate to be slid from the locked position to the unlocked position for removing a cassette from the storage compartment.

2. The package construction defined in claim 1 in which the slide projection extends outwardly from the slide plate and forms an undercut therewith; and in which said slide projection is slideably engaged within the slide channel of the housing to prevent outward movement of the slide plate away from the housing when the slide plate is in the locked position.

3. The package construction defined in claim 2 in which the slide channel has a T-shaped configuration including an enlarged rear portion; and in which the slide projection has a base complementary to the rear portion of the slide channel whereby said base is snap fitted into said rear portion of the slide channel.

4. The package construction defined in claim 1 in which the storage compartment includes an end wall; and in which the slide projection engages the end wall upon the slide plate reaching the locked position.

5. The package construction defined in claim 1 in which three slide channels are formed in the housing in an equally spaced relationship; and in which three slide projections are formed on the slide plate and are engageable with the three slide channels when the slide plate is engaged with the housing.

6. The package construction defined in claim 1 in which the locking tab means comprises at least a pair of resilient tabs formed on a wall of the housing; in which said tabs form a generally V-shaped configuration; and in which apex ends of the tabs retain the locking projection of the slide plate therebetween to secure said slide plate in the locked position.

7. The package construction defined in claim 6 in which the locking tab means includes two pairs of V-shaped tabs; in which two locking projections are formed on the slide plate, each of which has a wedge-shaped end; and in which the wedge-shaped ends extend between the apex ends of the locking tabs and are retained in locked engagement therewith by said apex ends engaging undercuts formed on the locking projections by said wedge-shaped ends.

8. The package construction defined in claim 7 in which the apex ends of the locking tabs are spaced apart forming a slot therebetween; in which a pair of camming surfaces are formed on each wedge-shaped end of the locking projections; in which said camming surfaces move the apex ends of the locking tabs apart as said wedge-shaped ends move through the slots and into locked position; and in which the resiliency of the locking tabs move said tabs into the undercuts.

9. The package construction defined in claim 6 in which opening means is formed in the slide plate for insertion of the key means therethrough for engagement with the locking tabs when the lock means is in locked position to disengage said tabs from the locking projection whereby the slide plate can be moved to the unlocked position.

10. The package construction defined in claim 7 in which each pair of the locking tabs is located within a separate compartment formed by spaced partition walls extending between a pair of parallel spaced walls, one wall of which forms part of the storage compartment.

11. The package constructon defined in claim 1 in which the access opening of the storage compartment is defined by spaced housing side walls, a first end wall and a second end wall having a retaining flange formed thereon; and in which the slide plate extends into the access opening when in locked position to prevent removal of a cassette therefrom.

12. The package construction defined in claim 1 in which the key means includes a plate having a plurality of tangs projecting outwardly from one end thereof.

13. The package construction defined in claim 1 in which the slide plate is hingedly mounted on the housing by a pair of hinges and an intervening hinge plate.

14. The package construction defined in claim 1 in which a plurality of reinforcing ribs are formed on the slide plate.

15. The package construction defined in claim 1 in which hanger means is formed integrally with the housing for supporting the housing when on display.

16. The package construction defined in claim 1 in which the package is formed of polypropylene.

17. The package construction defined in claim 1 in which the storage compartment includes a pivotally mounted cover movable between open and closed positions; and in which the slide plate when in locked position engages the cover when in the closed position to prevent movement of said cover from closed to open position for securing a cassette in the storage compartment.

18. A package construction for holding a cassette including:

(a) a housing having a cassette storage compartment formed therein, said compartment having an access opening for inserting and removing a cassette into and out of the compartment, said housing further having locking tab means and at least one slide channel formed thereon;

(b) a cover pivotally mounted on the housing and movable between open and closed positions for allowing and preventing, respectively, insertion and removal of a cassette into and out of the access opening of the storage compartment;

(c) lock means for releasably securing the cover in the closed position, said lock means comprising a slide plate integrally hingedly mounted on the housing and movable into and out of engagement with the cover between locked and unlocked positions, respectively, said slide plate having locking projection means formed thereon for slideable engagement with the housing locking tab means for retaining the slide plate in the locked position, and undercut slide projection means formed on said slide plate for slideably engaging the slide channel formed on the housing; and (d) key means engageable with the housing locking tab means for moving said tab means out of engagement with the slide plate locking projection means to enable the slide plate to be moved from the locked position to the unlocked position and out of engagement with the cover, whereby said cover may be moved to the open position for removing a cassette from the storage compartment.

19. The package construction defined in claim 18 in which the locking tab means comprises two pairs of flexible tabs; in which the tab pairs each form a V-shaped configuration; and in which the locking projection means comprises a pair of projections, each of which has a wedge-shaped end which engages a pair of the locking tabs to secure the slide plate in locked position.

20. A package construction for holding a cassette including:

(a) a housing having a cassette storage compartment formed therein, said compartment having an access opening for inserting and removing a cassette into and out of the compartment, said housing further having locking tab means formed thereon, said locking tabs comprising two pairs of flexible tabs, each pair forming a V-shaped configuration;

(b) a cover pivotally mounted on the housing and movable between open and closed positions for allowing and preventing, respectively, insertion and removal of a cassette into and out of the access opening of the storage compartment;

(c) lock means for releasably securing the cover in the closed position, said lock means comprising a slide plate integrally hingedly mounted on the housing and movable into and out of engagement with the cover between locked and unlocked positions, respectively, said slide plate having locking projection means formed thereon for slideable engagement with the housing locking tab means for retaining the slide plate in the locked position, said locking projection means comprising a pair of projections, each having a wedge-shaped end which engages a pair of the locking tabs to secure the slide plate in locked position; and (d) key means engageable with the housing locking tab means for moving said tab means out of engagement with the slide plate locking projection means to enable the slide plate to be moved from the locked position to the unlocked position and out of engagement with the cover, whereby said cover may be moved to the open position for removing a cassette from the storage compartment.

21. The package construction defined in claim 20 in which openings are formed in the slide plate; and in which the key means is insertable into the openings and into engagement with the locking tabs when the slide plate is in locked position to disengage said tabs from their respective locking projection enabling the slide plate to be moved to the unlocked position.

22. The package construction defined in claim 18 in which the cover is attached to an end of the storage compartment opposite of the lock means by a pair of strap hinges; and in which an elongated opening is formed between the strap hinges.

23. The package construction defined in claim 22 in which a plurality of ribs are formed on the cover adjacent the elongated opening between the strap hinges to maintain a cassette within the storage compartment when the cover is in the closed position.

24. The package construction defined in claim 23 in which the cassette is a compact disc and is located within one end of a flexible protective sleeve; and in which the sleeve is squeezed between the ribs when the cover is in the closed position.

25. A one-piece security package for a cassette, cartridge or a compact disc comprising:

(a) A storage compartment for a cassette, cartridge or compact disc with an opening through which a cassette, cartridge or compact disc can be received;

(b) a retainer integrally hinged to the storage compartment and hingedly moveable to a first position wherein said retainer is slideably and releasably retained on the storage compartment and which allows insertion and removal of a cassette, cartridge or compact disc into and from the storage compartment when said retainer is in said first position;

(c) means integral with the storage compartment and means integral with the retainer that interact to releasably retain the retainer in the first position and to slideably guide the retainer between the first position and a second position to prevent removal of a cassette, cartridge or compact disc from the storage compartment when the retainer is in said second position; and (d) a keeper integral with either the storage compartment or retainer and a latch integral with the other that interconnect with the retainer is slideably moved to the second position; wherein said keeper is a tab elongated in a direction at an acute angle to the direction of said back and forth sliding movement and said latch is a projection having a camming surface and a locking surface that coact with the tab when the retainer is slideably moved to the second position.

* * * * *